US009921527B2

(12) United States Patent
Rokugawa

(10) Patent No.: US 9,921,527 B2
(45) Date of Patent: Mar. 20, 2018

(54) IMAGE FORMING APPARATUS THAT USES TEMPERATURE VALUES TO CONTROL TRANSFER VOLTAGE APPLIED TO TRANSFER UNIT OF THE APPARATUS

(71) Applicant: Oki Data Corporation, Tokyo (JP)

(72) Inventor: Hiroshi Rokugawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/384,631

(22) Filed: Dec. 20, 2016

(65) Prior Publication Data

US 2017/0185008 A1 Jun. 29, 2017

(30) Foreign Application Priority Data

Dec. 25, 2015 (JP) ..... 2015-253920

(51) Int. Cl.
*G03G 15/16* (2006.01)

(52) U.S. Cl.
CPC ..... *G03G 15/1665* (2013.01); *G03G 15/1605* (2013.01)

(58) Field of Classification Search
CPC ..... G03G 15/1665; G03G 15/1605
USPC ..... 399/66, 313
See application file for complete search history.

(56) References Cited

U.S. PATENT DOCUMENTS 4,816,871 A * 3/1989 Oushiden ..... G03G 15/0266 361/229
5,649,265 A * 7/1997 Tabuchi ..... G03G 15/0266 399/44
5,701,556 A * 12/1997 Sugimoto ..... G03G 15/205 399/330
5,909,605 A * 6/1999 Nishizawa ..... G03G 15/1675 399/66
2008/0212987 A1* 9/2008 Kim ..... G03G 15/168 399/44
2011/0135357 A1* 6/2011 Okabayashi ..... G03G 15/2028 399/329
2015/0185666 A1* 7/2015 Nakaegawa ..... G03G 15/1665 399/66

FOREIGN PATENT DOCUMENTS

JP 2010-002753 A 1/2010
JP 2014-106413 A 6/2014

* cited by examiner

*Primary Examiner* — Quana M Grainger
(74) *Attorney, Agent, or Firm* — Panitch Schwarze Belisario & Nadel LLP

(57) ABSTRACT

An image forming apparatus includes a transfer unit having a conducive roller member formed with a conductive elastic body on an outer peripheral surface of a shaft of the conductive roller member for transferring, to a recording medium, development images formed on an image carrier based on a transfer voltage applied thereto, a voltage application unit for applying the transfer voltage to the transfer unit; a voltage control unit controlling the transfer voltage to be applied from the voltage application unit to the transfer unit, and a temperature measuring unit measuring shaft, temperature of the conductive roller member, wherein the voltage control unit controls the transfer voltage applied to the transfer unit based on the shaft temperature measured with the temperature measuring unit.

6 Claims, 9 Drawing Sheets

IMAGE FORMING APPARATUS THAT USES TEMPERATURE VALUES TO CONTROL TRANSFER VOLTAGE APPLIED TO TRANSFER UNIT OF THE APPARATUS

CROSS REFERENCE TO RELATED APPLICATION

This application claims priority benefits under 35 USC, section 119 on the basis of Japanese Patent Application No. 2015-253920, the disclosure of which is incorporated herein by reference.

BACKGROUND OF THE INVENTION

1. Field of the Invention

This invention relates to an image forming apparatus for forming images on recording media using an electrophotographic method.

2. Description of Related Art

Image forming apparatuses such as multicolor electrophotographic printers of an intermediate transfer method, generally have plural image forming units including such as, e.g., photosensitive drums, charge units, exposure units, and development units. The image forming units are provided sequentially along a medium conveyance route; a toner image is primarily transferred to an intermediate transfer belt from the image forming units of respective colors; and the toner image primarily transferred is secondarily transferred to the recording medium.

With such an image forming apparatus, the secondary transfer voltage is determined on the basis of electrical characteristics of the secondary transfer roller sought by measuring a secondary transfer current flowing when a prescribed secondary transfer voltage is applied where no recording medium exists at a and the opposed secondary transfer roller. The temperature inside the apparatus may change due to printing operation for a long time, and even where the electrical characteristic of the secondary transfer roller is changed, the electrical characteristics of the secondary transfer roller can be measured again by utilizing sheet interval (or namely printing interval) of the recording medium (see, Japanese Patent Application Publication No. 2010-2753 (A1), and Japanese Patent Application Publication No. 2014-106413 (A1)).

For example, where the recording medium is a continuous medium or medium in a web form, the recording medium always exists at the secondary transfer nipping portion, so that the electrical characteristics of the secondary transfer roller cannot be measured until the completion of printing. Where the printing operation is stopped as in a state that the recording medium exists at the secondary transfer nipping portion during the printing operation, the electrical characteristics of the secondary transfer roller cannot be measured at a time when resuming printing in substantially the same way. There arise problems that the secondary transfer voltage cannot be controlled in an optimum way, with prior art.

As an alternative method measuring the elected characteristics of the secondary transfer roller, a method can be thought in which the temperature value of the secondary transfer roller is measured to presume resistance change from the temperature value of the secondary transfer roller. With the temperature value measuring method using such as a contact type thermistor directly contacting the secondary transfer roller, because the surface of the secondary transfer roller is structured of a material including foamed urethane, the contact type or the secondary transfer roller may be worn according to rotation of the secondary transfer roller. To the contrary, a non-contact type thermistor is expensive by itself, and errors may occur in the measured temperature values due to attachment of toner. That is, many problems may occur in the method for presuming resistance change of the secondary transfer roller by directly measuring the temperature value of the secondary transfer roller.

It is therefore an object of the invention to provide an image forming apparatus capable of optimally controlling a secondary transfer voltage even where the resistance value of the secondary transfer roller is changed during printing operation using a continuous medium or web.

SUMMARY OF THE INVENTION

According to an aspect of the invention, an image forming apparatus includes: a transfer unit having a conductive roller member formed with a conductive elastic body on an outer peripheral surface of a shaft, of the conductive roller member for transferring, to a recording medium, development images formed on an image carrier based on a transfer voltage applied thereto; a voltage application unit for applying the transfer voltage to the transfer unit; a voltage control unit controlling the transfer voltage to be applied from the voltage application unit to the transfer unit; and a temperature measuring unit measuring shaft temperature of the conductive roller member, wherein the voltage control unit controls the transfer voltage applied to the transfer unit based on the shaft temperature measured with the temperature measuring unit.

These and other objects, features, aspects and advantages of the disclosed image forming apparatus will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure.

DETAILED DESCRIPTION OF EMBODIMENTS

Hereinafter, an embodiment according to the invention is described in detail with reference to the drawings.

Figure 1:
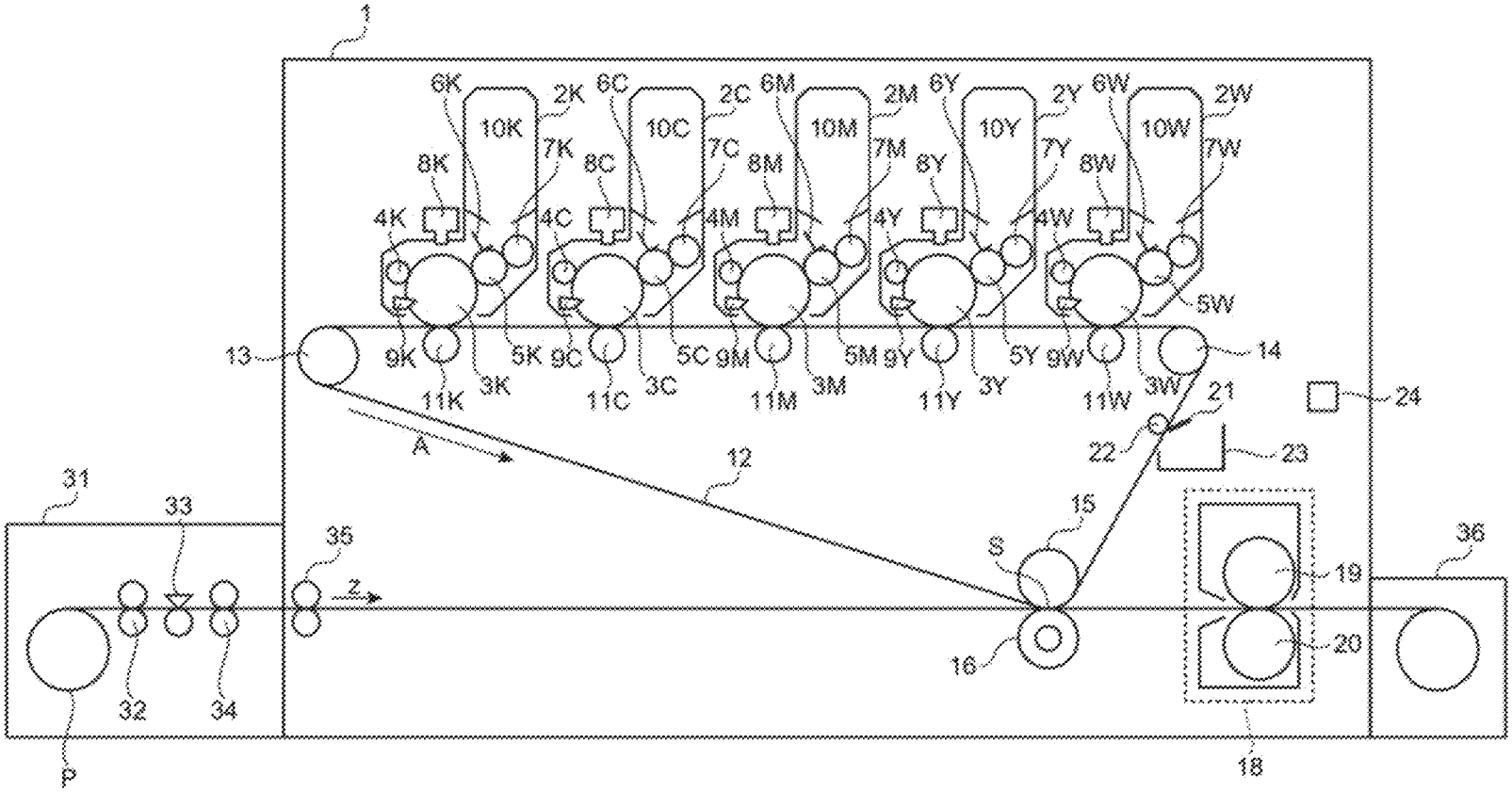
FIG. 1 is a schematic diagram showing a printer structure as an image forming apparatus according to an embodiment of the invention.
Figure 2:
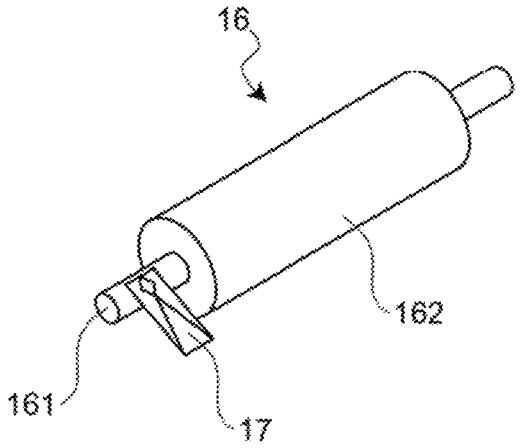
FIG. 2 is a schematic perspective view showing a structure of a secondary transfer roller according to the embodiment.

FIG. 1 shows a structure of a printer 1 as an image forming apparatus according to this embodiment. The printer 1 is an image forming apparatus of an intermediate transfer method capable of forming images using toners serving as developers on a roll paper P as a recording medium (or namely, continuous medium) in use of electrophotographic method. FIG. 2 is a perspective view showing a structure of a secondary transfer roller according to this embodiment.

As shown in FIG. 1, the printer 1 has independent image forming units 2W, 2Y, 2M, 2C, 2K for forming images using only five color toners, white (W), yellow (Y), magenta (M), cyan (C), and black (K), and the image forming units 2W, 2Y, 2M, 2C, 2K are structures to be detachably attached to the printer 1. The image forming units 2W, 2Y, 2M, 2C, 2K are orderly disposed in a row from an upstream side on a right side in FIG. 1 to a downstream side in the image forming direction. It is to be noted that although in this embodiment the five image forming units 2W, 2Y, 2M, 2C, 2K are described, unit sequence or number of the image forming units, or types of toner are not limited to those in the embodiment.

The printer 1 includes a roll paper feeder 31 mounting and holding a roll paper P, a rewinder 36 taking up the roll paper P after forming images, and an intra apparatus conveyance roller 35 conveying, to a secondary transfer roller 16 shown as z-arrow direction in FIG. 1, the roll paper P conveyed from the roll paper feeder 31 to the interior of the printer 1. The roll paper feeder 31 includes a feed roller 32 feeding the roll paper P in a wound state, a cutter 33 cutting the roll paper P, and an intra feeder conveyance roller 34 conveying the roll paper P to the interior of the printer 1. Formed are the secondary transfer roller 16 serving as a transfer unit for transferring toner images to the roll paper P, in contact with an intermediate transfer belt 12 holding and conveying the toner images (developer images) developed with the respective toners at the image forming units 2W, 2Y, 2M, 2C, 2K, and a fixing device 18 fixing the toner images transferred to the roll paper P. The roll paper P passing by the fixing device 18 is taken up by the rewinder 36.

The intermediate transfer belt 12 is an endless belt member tensioned by a secondary transfer opposition roller 15, a drive roller 13, and a driven roller 14. The intermediate transfer belt 12 is driven in an arrow A direction in FIG. 1 in a state carrying toner images developed at the image forming units 2W, 2Y, 2M, 2C, 2K by the drive roller 13 rotating from drive of a belt motor 61 described below, and conveys the toner images to a secondary transfer nipping portion S formed between the secondary transfer roller 16 and the secondary transfer opposition roller 15.

The secondary transfer roller 16 is disposed to oppose the secondary transfer opposition roller 15 and sandwiches the conveyed roll paper P together with the toner images primary transferred onto the intermediate transfer belt 12, thereby secondarily transferring, to the roll paper P, the toner images on the intermediate transfer belt 12 based on a prescribed transfer voltage (hereinafter, referred to as "secondary transfer voltage") applied from the secondary transfer voltage generator 45 described below. The secondary transfer roller 18 is structured to have a metal shaft 161 covered with a foamed urethane 162 with given conductivity as shown in FIG. 2. A contact type thermistor 17 serving as temperature measuring unit is attached to the metal shaft 161, and can measure the temperature of the metal shaft 161. The secondary transfer opposition roller 15 is structured, in substantially the same way as the secondary transfer roller 16, to have a metal shaft 151 covered with a foamed urethane 152 with given conductivity.

Referring again to FIG. 1, primary transfer rollers 11 (11W, 11Y, 11M, 11C, 11K) are arranged at respective portions opposing to photosensitive drums equipped at the image forming units 2W, 2Y, 2M, 2C, 2K, respectively, to primarily transfer, to the intermediate transfer belt 12, the toner images developed at the respective image forming units 2W, 2Y, 2M, 2C, 2K. The primary transfer rollers 11 (11W, 11Y, 11M, 11C, 11K) have a structure in which a metal shaft is covered with a urethane layer, and primarily transfer to the secondary transfer roller 12 the toner images developed on the respective surfaces of the photosensitive drums based on the prescribed primary transfer voltage applied, from a primary transfer voltage generator 44 described below.

The fixing device 18 includes a heat roller 19 and a pressure roller 20 pressing heat roller 19, and fixes the toner images transferred to the roll paper P. The heat roller 19 is formed of, e.g., a hollow cylindrical metal shaft made of aluminum covered with a silicone rubber heat resistance elastic layer, on which a PFA (tetrafluoroetylene-perfluoroalkylvinylether copolymer) tube is covered. A heater such as, e.g., halogen lamp, not shown, is provided inside the metal shaft. The pressure roller 20 has a structure that a metal shaft made of, e.g., aluminum is covered with a silicone rubber heat resistance elastic layer, on which a PFA is covered. The pressure roller 20 is arranged as to form a nipping portion between the roller 20 and the heat roller 19. The roll paper P with the toner images transferred at the secondary transfer nipping portion S is applied with heat and pressure at a time passing the nipping portion formed from the heat roller 19 maintained at a prescribed temperature and from the pressure roller 20, so that the toner is melt and that the toner images are fixed.

A cleaning blade 21 collecting secondary transfer remaining toner not being transferred to the roll paper P during the secondary transfer but remaining on the intermediate transfer belt 12 and collecting toner returned to the intermediate transfer belt 12 from the secondary transfer roller 17 by application of a cleaning voltage is arranged as to oppose a cleaning opposition roller 22 on a downstream side of the secondary transfer nipping portion B of the intermediate transfer belt 12. The cleaning belt 21 is structured of an elastic rubber material or plastic material and scrapes off the secondary transfer remaining toner remaining on the intermediate transfer belt 12 to the waste toner tank 23.

The image forming units 2W, 2Y, 2M, 2C, 2K are described next. The image forming units 2W, 2Y, 2M, 2C, 2K can have the same structure except the toner contained therein, and therefore, an image forming unit 2K for black color (K) is exemplified as one example.

The image forming unit 2K includes a photosensitive drum 3K serving as an image carrier, a charge roller 4K, a development roller 5K, a development blade 6K, a feed roller 7K, a cleaning blade 9K, and a toner cartridge 10K.

The photosensitive drum 3K is structured of a conductive support and a photoconductive layer, and is an organic photosensitive body having a structure in which a charge generation layer serving as the photoconductive layer and a charge transfer layer are sequentially accumulated, on a metal shaft made of aluminum serving as the conductive support, thereby forming electrostatic latent images based printing data according to radiation ray emitted from an LED (light emitting diode) head 8K provided immediately above the drum.

It is to be noted that the LED head 8K has, e.g., an LED array formed of LED elements and a lens array, and that is arranged at a position such that the radiation ray emitted from the LED elements based on instructions from a mechanism controller 52 described below focuses on the surface of the photosensitive drum 3K.

The charge roller 4K is structured of, e.g., a metal shaft such as stainless, and a semi-conductive epichlorohydrin rubber covers an outer peripheral surface of the metal shaft. The charge roller 4K is disposed as to press the photosensitive drum 3K thereby uniformly evenly charging the surface of the photosensitive drum 3K by a prescribed charge voltage applied from a charge voltage generator 41 described below.

The development roller 5K is structured of, e.g., a metal shaft such as stainless, and a urethane rubber dispersed with carbon black covers the outer periphery of the metal shaft. The surface of the urethane rubber is finished with isocyanate processing. The development roller 5K is disposed as to pressingly contact the surface of the photosensitive drum 3K, and reversely develops the toner images by attaching the toner to the electrostatic latent images formed on the surface of the photosensitive drum 3K with a prescribed development voltage applied from a development voltage generator 437 described below.

The development blade 6K is a developer layer thickness limiting member made of stainless steel having a thickness of, e.g., around 0.08 mm arranged as to press the surface of the development roller 5K at a prescribed position in a counter direction. The development blade 6K limits the thickness of the toner layer by pressing force to the surface of the development roller 5K, thereby forming a toner thin layer on the surface of the development roller 5K.

The feed roller 7K is structured of e.g., a metal shaft made of stainless steel and a semi-conductive formed silicone sponge layer covering the outer periphery of the metal shaft. The feed roller 7K is disposed as to contact pressingly the development roller 5K, and supplies toner or toners to the development roller 5K according to a prescribed feed voltage applied from the feed voltage generator 42 described below.

The cleaning blade 9K is structured of, e.g., a urethane rubber, whose one end is disposed to pressingly contact the surface of the photosensitive drum 3K at a prescribed position. The cleaning blade 9K cleans up the surface of the photosensitive drum 3K by scraping off fogging toner as well, as transfer leftover toner remaining on the surface of the photosensitive drum 3K, and reversely transferred toner from the image forming unit located on the upstream side in the image forming direction.

The toner cartridge 10K has a containing space for containing unused toner and supplies the unused toner to the feed roller 7K. It is to be noted that the printer 1 includes an environment sensor 24 as a surrounding temperature obtaining unit for measuring surrounding temperature of the apparatus.

Figure 3:
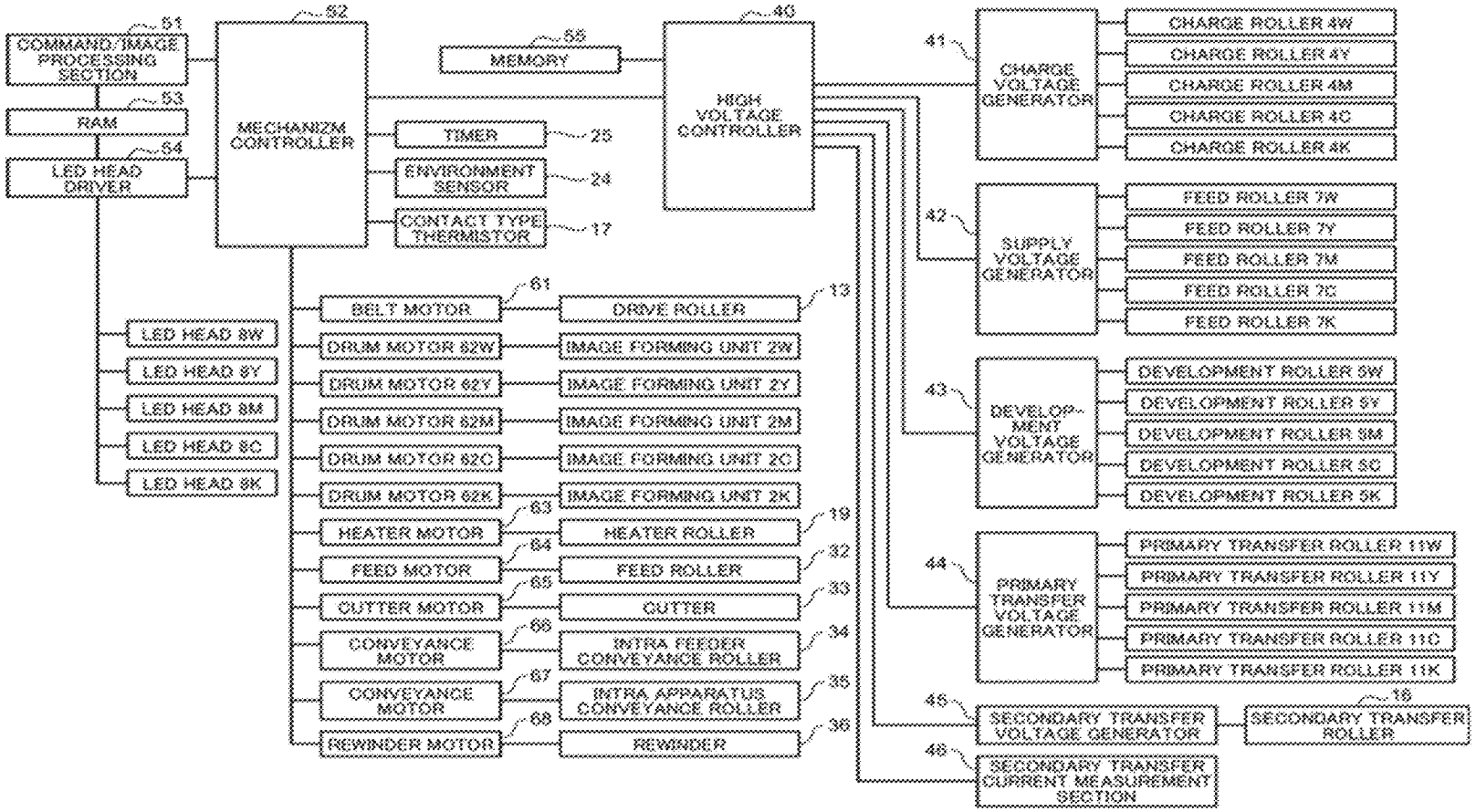
FIG. 3 is a control block diagram showing a control structure of the printer according to the embodiment.

Next, referring to FIG. 3 as a control block diagram, a control structure of the printer 1 according to this embodiment is described. The printer 1 includes a command/image processing section 51 receiving commands as printing instructions from the host computer, not shown, and printing data and writing data in a RAM (Random Access Memory) 53 upon processing the printing data and expanding the data to bitmap formats, a mechanism controller 52 controlling drives of a belt motor 61, drum motors 62W, 62Y, 62M, 62C, 62K, a heater motor 63. a feed motor 64, a cutter motor 65, conveyance motors 66, 67, and a rewinder motor 68 and operating the drive roller 13, the image forming units 2W, 2Y, 2M, 2C, 2K, the heat roller 19, the feed roller 32, the cutter 33, the intra feeder conveyance roller 34, the intra apparatus conveyance roller 35, and the rewinder 36, an LED head driver 54 controlling drives of the LED heads 8W, 8Y, 8M, 8C, 8K, and a high voltage controller 40 serving as a voltage controlling unit for controlling, based on the instructions from the mechanism controller 52, the charge voltage generator 41, the feed voltage generator 42, the development voltage generator 43, the primary transfer voltage generator 44, the secondary transfer voltage generator 45, and the secondary transfer current measurement section 46, serving as voltage application units.

The charge voltage generator 41 generates and stops supply of the charge voltage given to the charge rollers 4W, 4Y, 4M, 4C, 4K based on the instructions from the high voltage controller 40. The feed voltage generator 42 generates and stops supply of the feed voltage given to the feed rollers 7W, 7Y, 7M, 7C, 7K based on the instructions from the high voltage controller 40. The development voltage generator 43 generates and stops supply of the development voltage given to the development rollers 5W, 5Y, 5M, 5C, 5K based on the instructions from the high voltage controller 40. The primary transfer voltage generator 44 generates and stops supply of the primary transfer voltage given to the primary transfer rollers 11W, 11Y, 11M, 11C, 11K based on the instructions from the high voltage controller 40. The secondary transfer voltage generator 45 generates, stops supply of, and changes the secondary transfer voltage given to the secondary transfer roller 16 based on the distractions from the high voltage controller 40. The secondary transfer voltage generator 45 measures the secondary transfer current flowing the secondary transfer roller 16 based on the instructions from the high voltage controller 40.

A memory 55 is connected to the high voltage controller 40. The memory 55 memorizes respective bias setting values (namely, the charge voltage value, the feed voltage value, development voltage value, primary transfer voltage value, secondary transfer voltage value) at the charge voltage generator 41, the feed voltage generator 42, the development voltage generator 43, the primary transfer voltage generator 44, and the secondary transfer voltage generator 45. The memory 55 memorizes various values used at calculations of the temperature values of the secondary transfer roller 16. The high voltage controller 40 uses the measurement values from the contact type thermistor 17, the measurement results from the environment sensor 24, and the count values of a timer 25, at the calculation of the temperature values of the secondary transfer roller 16.

Figure 4:
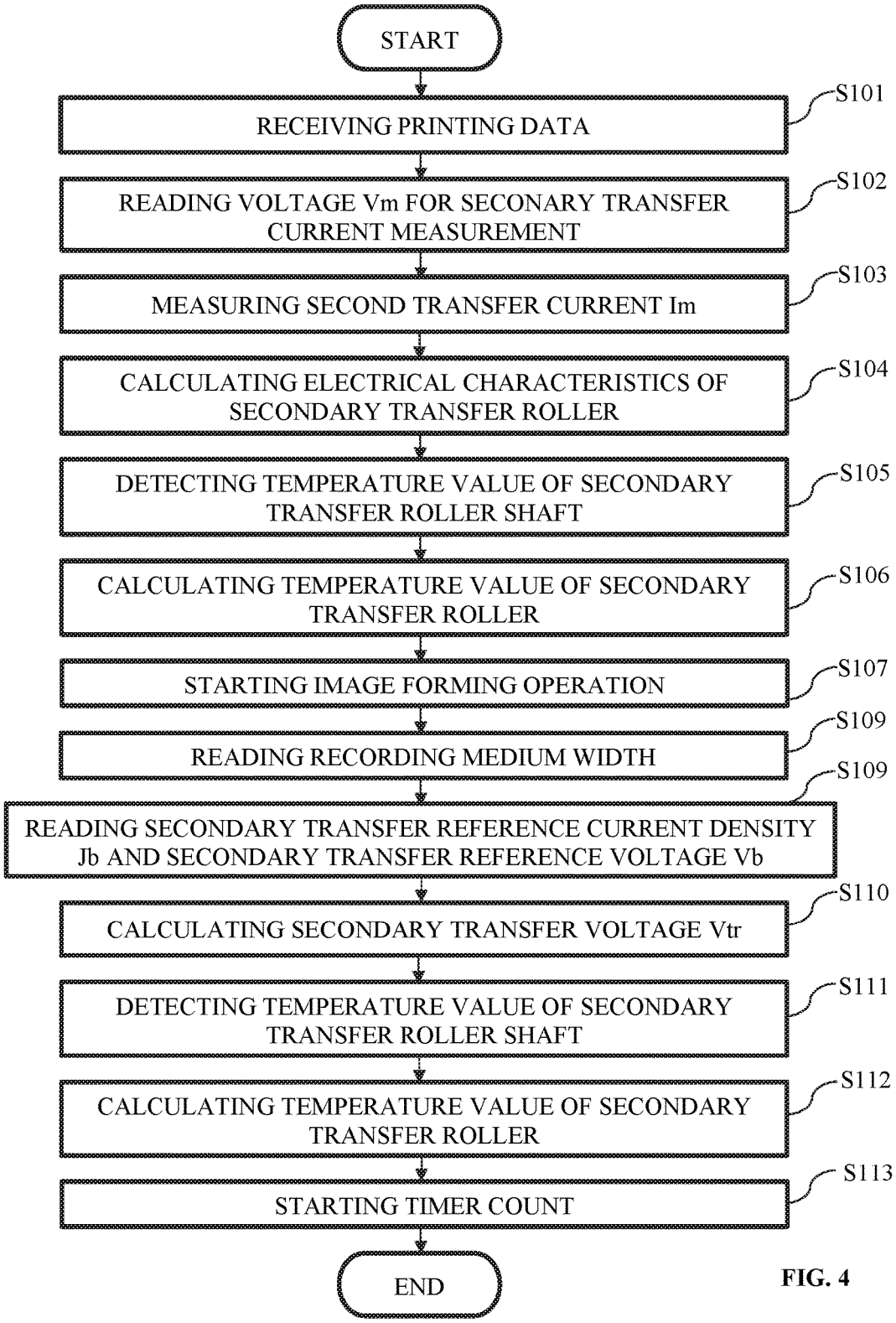
FIG. 4 is a flowchart showing operation calculating electrical characteristics and secondary transfer voltage Vtr of the secondary transfer roller where the printing operation starts in a state that no roll paper P exists at a secondary transfer nipping portion.

Next, the operation of the printer 1 is described. First, operation in which, the printing operation starts where no roll paper P exists at the secondary transfer nipping portion S is described. FIG. 4 is a flowchart showing operation calculating electrical characteristics and secondary transfer voltage Vtr of the secondary transfer roller where the printing operation starts in the state that no roll paper P exists at a secondary transfer nipping portion.

If the printer 1 receives printing data transmitted from a host computer not shown, at Step S101, the command/image processing section 51 provides an instruction to the mechanism controller 52 for warming up start and produces data in a bitmap format corresponding to respective colors upon expanding processing of the printing data.

The mechanism controller 52 receiving the instruction of the warming up start from the command/image processing section 51 drives the heat roller 19 by controlling the heat motor 63, and adjusts the fixing temperature by controlling the heater such as a halogen lamp, not shown.

The mechanism controller 52 controls the belt motor 61, and the drum motors 62W, 62Y, 62M, 62C, 62K and drives the drive roller 13, and the respective rollers of the image forming units 2W, 2Y, 2M, 2C, 2K.

The high voltage controller 40 receiving the output instruction of the voltage from the mechanism controller 52 reads out the charge voltage value, the feed voltage value, and the development voltage value memorized in the memory 55, and applies voltages to the respective rollers provided in the image forming units 2W, 2Y, 2M, 2C, 2K by controlling the charge voltage generator 41, the feed voltage generator 42, and the development voltage generator 43 based on those setting values.

The high voltage controller 40 reads out the secondary transfer current measurement voltage Vm memorized in the memory 55 (Step S102). The secondary transfer current measurement voltage Vm herein means a secondary transfer voltage applied to the secondary transfer roller 16 from the secondary transfer voltage generator 45 when measuring the secondary transfer current flowing the secondary transfer roller 16.

The high voltage controller 40 sequentially measures the secondary transfer current Im flowing the secondary transfer current measurement section 46 when sequentially applying the read secondary transfer current measurement voltage Vm to the secondary transfer roller 16 from the secondary transfer voltage generator 45, thereby memorizing the data in the memory 55 (Step S103). It is to be noted that, this secondary transfer current measurement is performed while at least the intermediate transfer belt 12 and the secondary transfer roller are driven and while no roll paper P exists at the secondary transfer nipping portion S.

The high voltage controller 40 at Step S104 calculates the electrical characteristics of the secondary transfer roller 16 from the measurement results obtained at Step S103.

Figure 5:
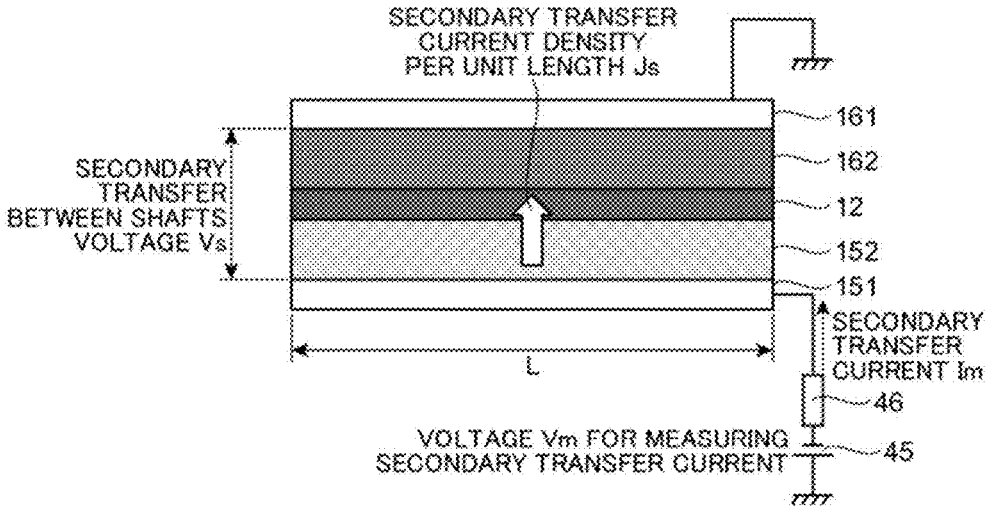
FIG. 5 is a schematic diagram showing a state of the secondary transfer nipping portion during measurement of secondary transfer current.

The calculation method of the electrical characteristics of the secondary transfer roller 16 is described herein. FIG. 5 is a schematic diagram showing a state of the secondary transfer nipping portion S during measurement of secondary transfer current.

The electrical characteristics of the secondary transfer roller 16 according to this embodiment is sought using a linear approximate formula given from a relation of secondary transfer between-shafts voltage V applied between the metal shaft 161 of the secondary transfer roller 16 and the metal shaft 151 of the secondary transfer opposition roller 151 and of secondary transfer current density J per unit length.

$$V=a\times J+b$$

The secondary transfer between-shafts voltage when the secondary transfer current measurement voltage Vm applies is set to Vs; The secondary transfer current density when the secondary transfer current flows through the secondary transfer roller 16 is set to Jm; The resistance of a secured resistor is set to R; A length of the secondary transfer roller 16 in the main scanning direction (length in the longitudinal direction is set to L. Coefficients a, b of the linear approximate formula given from the relation between the secondary transfer between-shafts voltage Vs and the secondary transfer current density J per unit length are sought.

The secondary transfer between-shafts voltage Vs and the secondary transfer current density J are sought as follows;

$$Vs1=Vm1-Im1\times R$$

$$Vs2=Vm2-Im2\times R$$

$$Jm1=Im1/L$$

$$Jm2=Im2/L$$

Therefore, the coefficients a, b of the linear approximate formula are given from the following formulae:

$$a=(Vs2-Vs1)/(Jm2-Jm1)$$

$$b=(Vs1\times Jm2-Vs2\times Jm1)/(Jm2-Jm1)$$

In this embodiment, the temperature value of the secondary transfer roller 16 is calculated at the same time as the measurement of the electrical characteristics of the secondary transfer roller 16. This is used for calculations of the temperature value and the secondary transfer voltage Vtr of the secondary transfer roller during the printing operation or where the printing operation is returned in a state that a roll paper P exists at the secondary transfer nipping portion S.

The high voltage controller 40 obtains the temperature value of the metal shaft of the secondary transfer roller 16 from the contact type thermistor 17 at Step S105.

The high voltage controller 40 at Step S106 calculates the temperature value of the secondary transfer roller 16 from the temperature value of the metal shaft 161 of the secondary transfer roller 16 obtained at Step S105. In this embodiment, the high voltage controller 40 calculates the temperature value of the secondary transfer roller 16 with the following formulae where the temperature value of the metal shaft 161 of the secondary transfer roller is set to Tss; the temperature value of the secondary transfer roller 16 at a time of the previous printing operation stop is set to Te; the coefficient memorized in the memory 55 is set to $\alpha$; the time lapse from the time of the previous printing operation stop is set to te. The temperature value T of the secondary transfer roller 16 is calculated with the following formula.

$$T=Ts+(Te+Ts)\times exp(-\alpha\times te)$$

The high voltage controller 40 memorizes the calculated, temperature value T in the memory 55 as the temperature Te at the time of calculation of the electrical characteristics of the secondary transfer roller 16.

At Step S107, image forming operation is executed. First, the image forming operation using the toners performed at the image forming units 2W, 2Y, 2M, 2C, 2K is described. As described above, the image forming units 2W, 2Y, 2M, 2C, 2K have the same structure except the toners contained therein, and perform the same image forming operation. In the following description, the parts of reference numbers W, Y, M, C, K to identify the image forming unit are removed for the sake of brevity.

The mechanism controller 52 applies the charge voltage of −1000 V to the charge roller 4 by controlling the high voltage controller 40 and the charge voltage generator 41, thereby charging the surface of the photosensitive drum 3 to be −600 V. After the photosensitive drum 3 is charged, the mechanism controller 52 exposes the photosensitive drum 3 by emitting the LED head 8 via the LED bead driver 54 based on data in the bitmap format produced by the command/image processing section 51, thereby charging the drum to be −50V to form the electrostatic latent images on the surface of the photosensitive drum 3.

The electrostatic latent images formed on the surface of the photosensitive drum 3 reaches the contact portion of the development roller 5 according to rotation of the photosensitive drum 3. The mechanism controller 52 at that time charges controls the high voltage controller 40, the development voltage controller 43, and the feed voltage controller 42 to apply the development voltage of −200 V to the development roller 5 and to apply the feed voltage of −250 V to the feed roller 7. With this operation, the toner supplied from the toner cartridge 10 is triboelectrically charged to a negative polarity by the development roller 5 and the feed roller 7.

The toner triboelectrically charged to the negative polarity is attached onto the development roller 5 according in the potential difference between the development roller 5 and feed roller 7. The toner attached to the development roller 5 is limited to have a uniform thickness by the development blade 6. The toner layer formed on the development roller 5 is conveyed to the contact portion to the photosensitive drum 3 according to the rotation of the development roller 5. At the exposure portion at which the surface of the photosensitive drum 3 is electrostatically removed to −50 V between the development roller 5 and the photosensitive drum 3, electrical field is formed in a direction from the photosensitive drum 3 to the development roller 5. With this operation, the toner triboelectrically charged to the negative polarity on the development roller 5 is attached to the exposure portion, or namely electrostatic latent images, on the surface of the photosensitive drum 3, thereby developing the toner images.

In synchrony with the timing that the developed toner images reach the primary transfer portion, the mechanism controller 52 provides a production instruction of the transfer voltage to the primary transfer voltage generator 44. The mechanism controller 52 reads out the primary transfer voltage setting value memorized in the memory 55, and applies the primary transfer voltage to the primary transfer rollers 11 (11W, 11Y, 11M, 11C, 11K) from the primary transfer voltage generator 44. The toner images developed on the surface of the photosensitive drum 3 at that time are primarily transferred to the intermediate transfer belt 12 at the primary transfer position according to the electrical field formed between the transfer roller 11 and the photosensitive drum 3.

The high voltage controller 40 calculates the secondary transfer voltage Vtr applied to the secondary transfer roller 16 for secondarily transferring the toner images on the intermediate transfer belt 12 to the roll paper P during a period to a timing that the toner images primarily transferred onto the intermediate transfer belt 12 reach the secondary transfer nipping portion S formed with the secondary transfer roller 16 and the secondary transfer opposition roller 15.

It is to be noted that the secondary transfer voltage Vtr where the printing operation starts while no roll paper P exists at the secondary transfer nipping portion S, can be calculated based on the electrical characteristics of the secondary transfer roller 16 calculated at Step S104 and the information on the roll paper width (medium width) contained in the printing data received from the printer 1.

That is, at Step S108, the high voltage controller 40 reads out the information on the medium width in the setting information of the roll paper P contained in the received printing data.

The high voltage controller 40 at Step S109 reads out the secondary transfer reference current density Jb and the secondary transfer reference voltage Vb memorized in the memory 55 based on the setting information (medium width) of the roll paper P contained in the printing data. The secondary transfer reference current density Jb means necessary current density flowing through the inside of the medium region to make the secondary transfer good, and the secondary transfer reference voltage Vb means the voltage applied to the recording medium at that time. It is to be noted that the inside of the medium region means a region contacting between the secondary transfer roller 16 and the secondary transfer opposition roller 15 via the intermediate transfer belt 12 and the roll paper P.

The high voltage controller 40 at Step S110 calculates the secondary transfer voltage Vtr from the electrical characteristics of the secondary transfer roller 16 sought at Step S104, the secondary transfer reference current density Jb and the secondary transfer reference voltage Vb read out at Step S109, and the information of the medium width of the roll paper P read out at Step S108.

Figure 6:
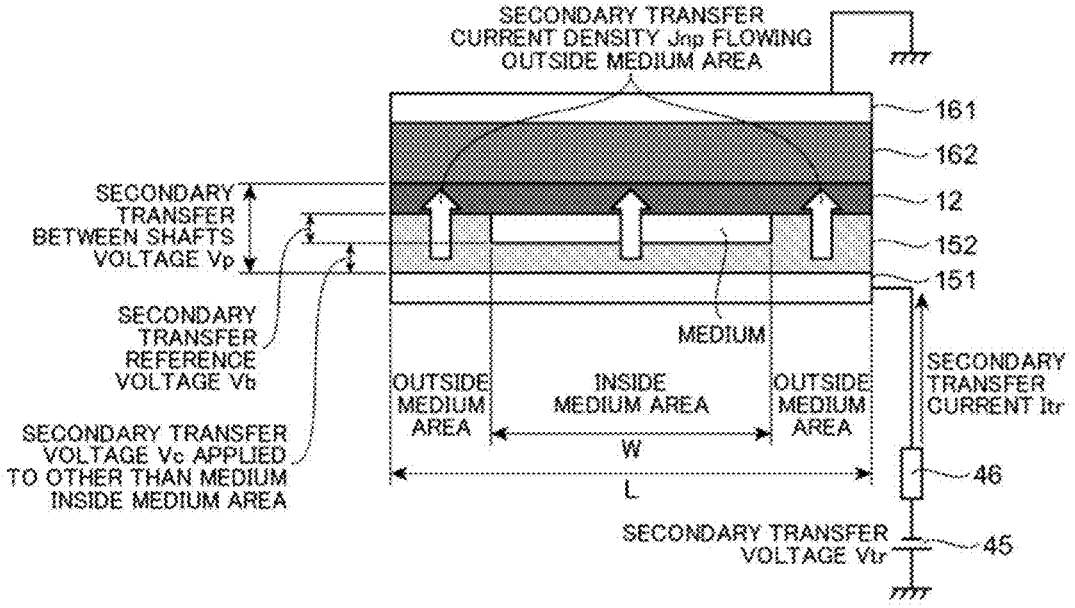
FIG. 6 is a schematic view showing a state of the secondary transfer nipping portion during secondary transfer.

FIG. 6 is a schematic diagram showing a state of the secondary transfer nipping portion S during the secondary transfer. The high voltage controller 40, as shown in FIG. 6, calculates the secondary transfer voltage Ve applied to a portion other than the medium (roll paper P) in the inside of the medium region using the electrical characteristics (a, b) of the secondary transfer roller 16 sought at Step S104 when the current density at the roll paper P is the secondary transfer reference current density Jb.

$$Vc=a\times Jb+b$$

The secondary transfer between shafts voltage Vp applied between the metal shift 161 and the secondary transfer opposition roller shaft 151 of the secondary transfer roller while the roll paper P exists at the secondary transfer nipping portion S is as follows.

$$Vp=Vb1+Vc$$

At that time, the secondary transfer current density Jnp as the density of current flowing the outside of the medium region is sought by the electrical characteristics (a, b) of the secondary transfer roller 16 sought at Step S104.

$$Jnp=(Vp-b)/a$$

If the width of the roll paper P is set to W, the necessary secondary transfer current, Itr following through the secondary transfer roller 16 to make the secondary transfer good is as follows, because the current is the summation of the secondary transfer currents flowing through the inside of the medium region and the outside of the medium region.

$$Itr=Jb1\times W+Jnp\times(L-W)$$

The secondary transfer voltage Vr applied to the secured resistance R when the secondary transfer current flows the secondary transfer roller 16 is as follows.

$$Vr=Itr\times R$$

Because the secondary transfer voltage Vt necessary for flowing the secondary transfer current Itr to the secondary transfer roller 16 is a summation of the secondary transfer between shafts voltage Vp and the secondary transfer voltage Vr applied to the secured resistance, the secondary transfer voltage Vtr is set as fellows.

$$Vtr=Vp+Vr$$

When the image forming position on the roll paper P reaches the secondary transfer nipping portion S, the mechanism controller 52 generates the secondary transfer voltage Vtr calculated by the high voltage controller 40 at Step S110 at the secondary transfer voltage generator 45, thereby applying the voltage to the secondary transfer roller 16. With this operation, the toner images on the intermediate transfer belt 12 secondarily transferred to the roll paper P. The toner images secondarily transferred are given at the fixing device 18 heat and pressure when passing by the nipping portion formed of the heat roller 19 maintained at the prescribed temperature and the pressure roller 20, and are fixed upon melting the toner. The roll paper P on which the toner images are fixed is conveyed to the rewinder 36 and taken up by the rewinder 36.

It is to be noted that mechanism controller 52 calculates the temperature value of the secondary transfer roller 16 and counts using the timer 25 at the end of the printing operation. This is for obtaining the temperature value To of the secondary transfer roller 16 at the time of the previous printing operation stop and for obtaining the time lapse te from the previous printing operation stop, to be used when the temperature value of the secondary transfer roller 16 is calculated.

That is, the mechanism controller 52 provides an instruction to the high voltage controller 40 to calculate the temperature value of the secondary transfer roller 16 at Step S111. The instructed high voltage controller 40 obtains the temperature value of the metal shaft 161 of the secondary transfer roller 16 from the contact type thermistor 17.

The high voltage controller 40 calculates the temperature value of the secondary transfer roller 16 from the temperature value of the metal shaft 161 of the secondary transfer roller 16 obtained at Step S111. In this embodiment, the temperature value T of the secondary transfer roller 16 is calculated according to the formula below where: the temperature value of the metal shaft 161 is set to Ts; the measurement temperature value of the environment sensor 24 is set to To; the coefficient memorized in the memory 55 is set to k.

$$T=Ts-(Ts-To)\times k$$

The coefficient k memorized in the memory 55 is a coefficient changeable according to the printing speed of the printer 1, and an experimentally obtained value is memorized in the memory 55. The temperature value T of the secondary transfer roller 16 is memorized in the memory 55 as the temperature value Te at the time of the printing operation stop.

Finally, the mechanism controller 52 counts the time lapse from the printing completion using the timer 25 (Step S113)

Differences of the formulae for temperature value calculations of the secondary transfer roller 16 calculated using the temperature value of the metal shaft 161 of the secondary transfer roller 16 obtained from the contact type thermistor 17 are described.

Figure 7:
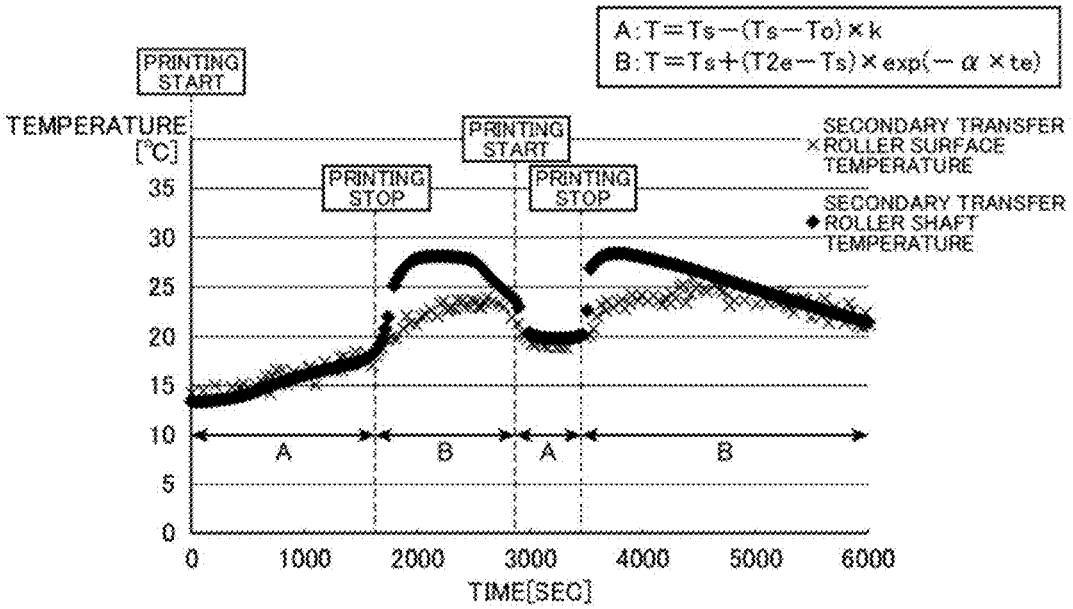
FIG. 7 is a graph showing an experiment result in which metal shaft temperature of the secondary transfer roller and secondary transfer roller temperature are measured during printing operation and operation stop of the printer.

FIG. 7 shows an experiment result in which the temperature value of the metal shaft 161 of the secondary transfer roller 16 and the temperature value of the secondary transfer roller 16 are measured during printing operation and operation stop of the printer 1. From FIG. 7, it is turned out that there are temperature change differences of the metal shaft 161 of the secondary transfer roller 16 and the secondary transfer roller 16 between during the printing operation and during the printing operation stop. This is because the metal shaft 161 structuring the secondary transfer roller 16 and the foamed urethane 162 are different materials and because the speeds of the temperature change are also different from each other. In this embodiment, therefore, the calculation formula used for presuming the temperature value of the secondary transfer roller 16 from the metal shaft 161 of the secondary transfer roller 16 is switched between during the printing operation and during the printing operation stop. It is to be noted that the temperature value during the stop is necessarily presumed because the temperature value immediately after resuming the printing operation is approximated from the temperature value at the time of the printing operation stop.

A. Temperature Value Calculation During Printing Operation

During continuous printing operation, the temperature value of the secondary transfer roller 16 is calculated based on the temperature value of the metal shaft 161 of the secondary transfer roller 16 obtained from the contact type thermistor 17 and the temperature value of the apparatus surrounding obtained from the environment sensor 24. The temperature value T of the secondary transfer roller 16 is calculated according to the following formula where the temperature value of the metal shift 161 is set to Ts; the measured temperature value of the environment sensor 24 is set to To; the coefficient memorized in the memory 55 is set to k.

$$T=Ts-(Ts-To)\times k \qquad \text{Formula (A)}$$

The coefficient k memorized in the memory 55 is a coefficient changing according to the printing speed of the printer 1, and the value sought experimentally is memorized in the memory 55.

It is to be noted that during the printing operation, the secondary transfer roller 16 comes into a state that always contacting the roll paper P cooled at the environmental temperature. The temperature value of the secondary transfer roller 16 is set lower than the temperature value of the metal shaft 161 because cooled with the roll paper P. In consideration of this relationship, it is devised to presume the temperature value of the secondary transfer roller 16 from the temperature value of the metal shaft 161 with Formula (A).

B. Temperature Value Calculation During the Printing Operation Stop (or Resuming the Printing Operation)

During the printing operation stop, the temperature value of the secondary transfer roller 16 is calculated based on the temperature value of the metal shaft 161 of the secondary transfer roller 16 obtained from the contact type thermistor 17 and the temperature value of the secondary transfer roller 16 at the time of the previous printing operation stop. The temperature value T2 of the secondary transfer roller 16 is calculated according to the following formula where the temperature value of the metal shaft 161 is set to Ts; the temperature value of the secondary transfer roller 16 at the time of the previous printing operation stop is set to Te; the coefficient memorized in the memory 55 is set to α; and the time lapse from the time of the previous printing operation stop is set to te.

$$T2=Ts-(Te-Ts)\times exp(-\alpha\times te) \qquad \text{Formula (B)}$$

The temperature value Te of the secondary transfer roller 16 at the time of the previous printing operation stop is calculated from the temperature value calculation formula during the printing operation. The coefficient α memorized in the memory 55 is a coefficient changing according to the printing speed of the printer 1, and the value sought experimentally is memorized in the memory 55.

It is to be noted that during the printing operation, the temperature change between the secondary transfer roller 16 and the metal shaft 161 may be different because the thermal, conductivities of those are different front each other, but when time goes enough, the temperature value of the secondary transfer roller 16 and the surface temperature of the metal shaft 161 become the same temperature value. It is generally known that cooling of the thermal conductivity changes in an exponential way, and in consideration of this relation, it is devised to presume the temperature value of the secondary transfer roller 16 with Formula (B) using the temperature value of the metal shaft 161, the initial temperature of the secondary transfer roller, and the time lapse.

Figure 8:
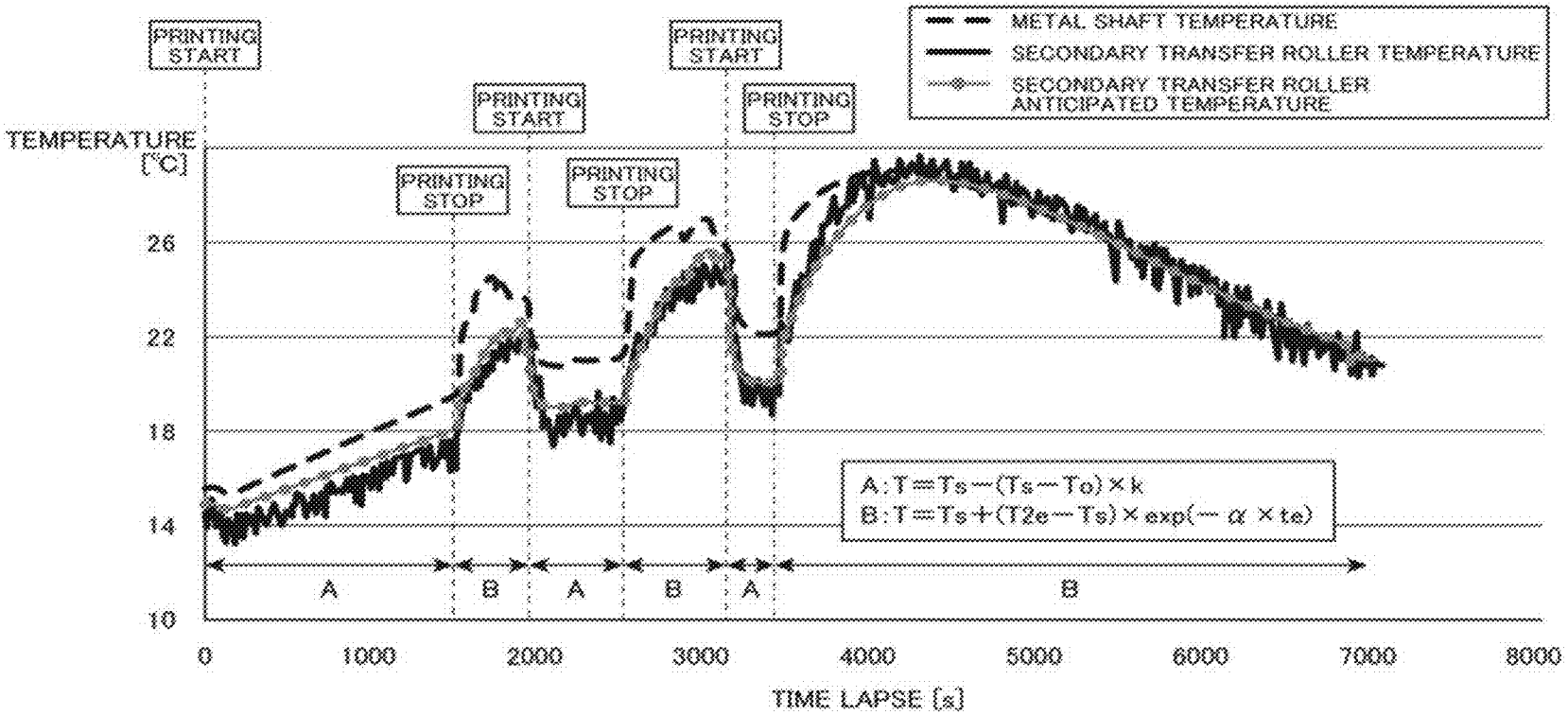
FIG. 8 is a graph showing actual measured values measuring metal shaft temperature of the secondary transfer roller and secondary transfer roller temperature where the printing operation and the operation stop are repeated under an environment of room temperature of 10 degrees Celsius, and showing results presuming the secondary transfer roller temperature from the metal shaft temperature.

FIG. 8 shows a result actually measuring the temperature value of the metal shaft 161 (measured with the contact type thermistor 17: shown with broken line) and the temperature value of the secondary transfer roller 16 (measured with a thermopile; shown with a solid line) where the printing operation of the printer 1 and the printing operation stop are repeated under a circumstances of the room temperature of 10 degrees Celsius, and a result (gray solid line) presuming the temperature value of the secondary transfer roller 16 from the temperature value of the metal shaft 161 using Formulae (A), (B). As shown in FIG. 8, it is confirmed that the temperature value of the secondary transfer roller 16 is presumable by adjusting the coefficient k in Formula (A) and the coefficient α in Formula (B). In such a situation, the coefficient k in Formula (A) is set to k=0.2, whereas the coefficient α in Formula (B) is set to 0.2.

Figure 9:
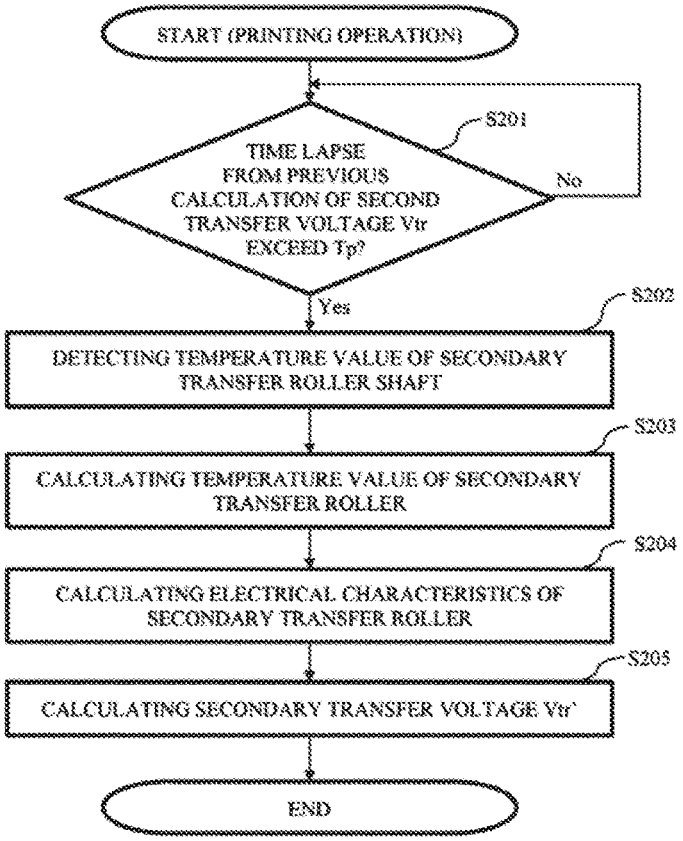
FIG. 9 is a flowchart showing a method for correcting the secondary transfer voltage Vtr during printing operation.

A method for correcting the secondary transfer voltage Vtr during the printing operation is described using a flowchart, in FIG. 9. This operation is performed, in a situation where the printing operation is not ended and continued at Step S110 in FIG. 4.

The high voltage controller 40 during the printing operation, counts the time lapse from the previous calculation and renewal of the secondary transfer voltage Vtr using the timer 25. If the counted time exceeds the prescribed time lapse Tp memorized in the memory 55 (Yes at Step S201), the mechanism controller 52 shafts the processing to Step S202. In the embodiment, the prescribed time lapse Tp is set to two minutes. In this embodiment, though the secondary transfer voltage Vtr is renewed based on the time lapse, but this invention is not limited to this, and the renewal timing can be determined based on the temperature measured value of the metal shaft 161 of the secondary transfer roller 16 obtained from the contact type thermistor 17.

At Step S202, the high vintage controller 40 obtains the temperature value of the metal shaft 161 of the secondary transfer roller 16 from the contact type thermistor 17.

Next, the high voltage controller 40 calculates the temperature value of the secondary transfer roller 16 from the temperature value f the metal shaft 161 obtained at Step S202 (Step S203). In this embodiment, the temperature value T of the secondary transfer roller 16 is calculated according to the following formula where the temperature value of the metal shaft 161 is set to Ts; the measured temperature value of the environment sensor 24 is set to To: the coefficient memorized in the memory 55 is set to k.

$$T=Ts-(Ts-To)\times k$$

The high voltage controller 40 calculates resistance change of the secondary transfer roller 16 from the time of the previous electrical resistance calculation using the temperature value T of the secondary transfer roller 16 calculated at Step S203. It is to be noted that in this embodiment, Step S106 in FIG. 4 is set to the timing of the previous electrical resistance calculation.

Figure 10:
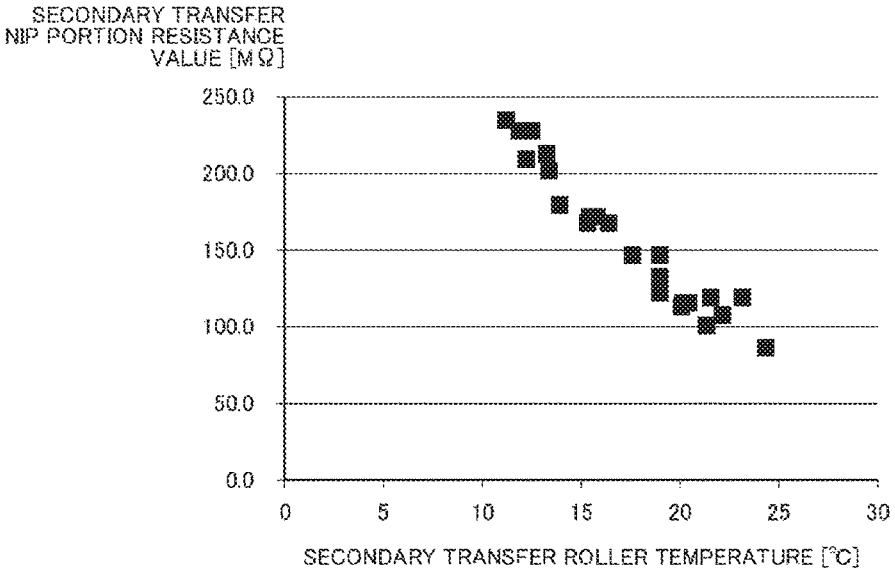
FIG. 10 is a graph, showing an experiment result measuring correlation relationship between temperature value of the secondary transfer roller and resistance of the secondary transfer nipping portion.

FIG. 10 shows an experiment result measuring correlation relationship between temperature value of the secondary transfer roller 16 and resistance of the secondary transfer nipping portion S. As apparent from FIG. 10, it turns out that there is a correlation relationship between, temperature value of the secondary transfer roller 16 and reliance of the secondary transfer nipping portion. Therefore, the resistance change of the secondary transfer roller 16 can be presumed by measuring the temperature change of the secondary transfer roller 16.

That is, the resistance change R is calculated as follows from the temperature value T of the secondary transfer roller 16 calculated at Step S203 and the temperature value Tc of the secondary transfer roller 16 calculated at Step S106.

$$R=(T-Tc)\times c$$

The coefficient c is a linear approximation coefficient obtained in an experimental way from the correlation relationship between temperature value of the secondary transfer roller 16 and the resistance value of the secondary transfer nipping portion S, shown in FIG. 10.

The high voltage controller 40 calculates the electrical characteristics of the secondary transfer roller 16 at Step S204.

More specifically, from the electrical characteristics of the secondary transfer roller 16 calculated at Step S104 in FIG. 4, the secondary transfer current Im is calculated as follows from the secondary transfer current measurement voltage Vm and the resistance value Rm of the secondary transfer nipping portion S.

$$Im1=Vm1/Rm1$$

$$Im2=Vm2/Rm2$$

With those relationship formulae, the secondary transfer current Im' when the resistance value at the secondary transfer nipping portion S changes only ΔR is sought as follows.

$$Im1'=Vm1/(Rm1+\Delta R)$$

$$Im2'=Vm2/(Rm2+\Delta R)$$

The secondary transfer between shafts voltage Vs' and the secondary transfer current density Jm' when the resistance value at the secondary transfer nipping portion S changes only ΔR are sought as follows.

$$Vs1'=Vm1-Im1'\times R$$

$$Vs2'=Vm2-Im2'\times R$$

$$Jm1'=Im1'/L$$

$$Jm2'=Im2'/L$$

The coefficients a', b' of the linear approximation formulae when the resistance value at the secondary transfer nipping portion S changes only ΔR are sought as follows.

$$a'=(Vs2'-Vs1')/(Jm2'-Jm1')$$

$$b'=(Vs1'\times Jm2'-Vs2'\times Jm1')/(Jm2'-Jm1')$$

At Step S205, the high voltage controller 40 uses the secondary transfer reference current density Jb and the secondary transfer reference volume Vb read out of the memory 55 at the start of the printing operation to calculate the secondary transfer voltage Vtr'. The high voltage controller 40 calculates the secondary transfer voltage Vtr' from the electrical characteristics of the secondary transfer roller 16 calculated at Step S204, the secondary transfer reference current density Jb and the secondary transfer reference voltage Vb read out at Step S109 in FIG. 4, and the information on the medium width of the roll paper P read out at Step S108. The calculation method is described as follows.

The secondary transfer voltage Vc' applying to outside of the medium or namely the roll paper P in the medium region where the current density of the roll paper P is the secondary transfer reference current density Jb1 is calculated using the electrical characteristics (a', b') of the secondary transfer roller 16 sought at Step S204.

$$Vc'=a'\times Jb1+b'$$

The secondary transfer between shafts voltage Vp' applying between the metal shaft 161 of the secondary transfer roller and the secondary transfer opposition roller shaft 151 in a state where the roll paper P exists at the secondary transfer nipping portion S is as follows.

$$Vp'=Vb1+Vc'$$

At that time, the secondary transfer current density Jnp' as the density of the current flowing the outside of the medium region is sought from the electrical characteristics (a', b') of the secondary transfer roller 16 sought at Step S204.

$$Jnp'=(Vp'-b')/a'$$

If the width of the roll paper P is set to W, the secondary transfer current Itr' necessary to flow the secondary transfer roller 16 to make the secondary transfer good is a summation of the secondary transfer currents flowing through the inside and the outside of the medium region, and the formula is as follows.

$$Itr'=Jb1\times W+Jnp'\times(L-W)$$

The secondary transfer voltage Vr' applying to the secured register R where the secondary transfer current flows the secondary transfer roller 16 is as follows.

$$Vr'=Itr'\times R$$

The secondary transfer voltage Vtr' necessary to flow the secondary transfer current Itr' through the secondary transfer roller 16 is a summation of the secondary transfer between shafts voltage Vp' and the secondary transfer voltage Vr' applying to the secured resistance, and therefore the secondary transfer voltage Vtr' is sought as follows.

$$Vtr'=Vp'+Vr'$$

Figure 11:
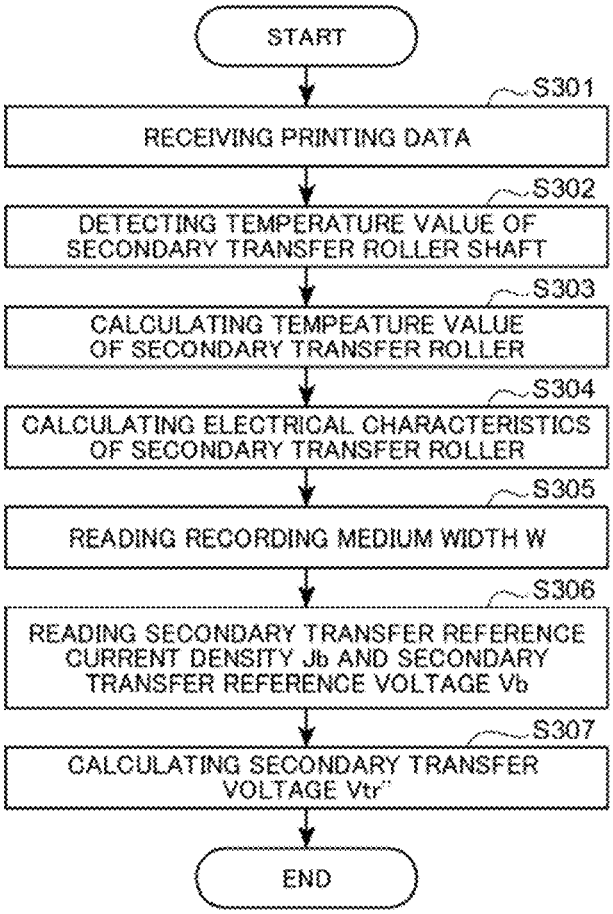
FIG. 11 is a flowchart showing a method calculating secondary transfer voltage Vtr" when the printing operation is resumed where the printing operation is stopped in a state that a roll paper P exists at the secondary transfer nipping portion.

Referring to a flowchart in FIG. 11, a method for calculating the secondary transfer voltage Vtr" when resuming the printing operation where the printing operation is stopped in a state that the roll paper P exists at the secondary transfer nipping portion S, is described. In this situation, though the resistance value of the secondary transfer roller 16 may be changed from temperature change of the interior of the printer 1, the electrical characteristics of the secondary transfer roller 16 cannot be calculated because the roll paper P exists, at the secondary transfer nipping portion S. In this embodiment, therefore, the secondary transfer voltage Vtr" is calculated using the electrical characteristics of the secondary transfer roller 16 at the previous calculation and the temperature change of the secondary transfer roller 16 from the time of the previous calculation of the electrical characteristics. This operation is in a situation that the printing operation is resumed at Step S301 in FIG. 11 upon completion of the printing operation at Step S113 in FIG. 4.

The high voltage controller 40 starts calculation of the secondary transfer voltage Vtr" at Step S301 upon reception of the printing data sent from the host computer, not shown.

Next, the high voltage controller 40 obtains the temperature value of the metal shaft 161 of the secondary transfer roller 16 from the contact type thermistor 17 at Step S302.

The high voltage controller 40 calculates the temperature value of the secondary transfer roller 16 from the temperature value of the metal shaft 161 of the secondary transfer roller obtained at Step S302 (Step S303). In this embodiment, the high voltage controller 40 calculates the temperature value T of the secondary transfer roller 16 with the following formula where the temperature value of the metal shaft 161 of the secondary transfer roller is set to Ts; the temperature value of the secondary transfer roller 16 at the time of the previous printing operation stop is set to Te; the coefficient memorized in the memory 55 is set to α; and the time lapse from the time of the previous printing operation stop is set to te.

$$T=Ts+(Te-Ts)\times exp(-\alpha\times te)$$

The high voltage controller 40 calculates the resistance change oft he secondary transfer roller 16 with the following formula from the temperature value T of the secondary transfer roller 16 calculated at Step S303. The coefficient c is a linear approximation coefficient obtained in an experimental way from the correlation relationship between temperature value of the secondary transfer roller 16 and the resistance value of the secondary transfer nipping portion S, shown in FIG. 10. The resistance change ΔR is calculated as the following formula from the temperature value T of the secondary transfer roller 16 calculated at Step S303 and temperature Te at the time of the previous calculation of the electrical characteristics of the secondary transfer roller 16 calculated at Step S106 in FIG. 4.

$$\Delta R=(T-Tc)\times c$$

At Step S304, the high, voltage controller 40 calculates the electrical characteristics of the secondary transfer roller 16.

More specifically, according to the electrical characteristics of the secondary transfer roller 16 calculated at Step S104 in FIG. 4, the secondary transfer current Im is as follows from the secondary transfer current measurement voltage Vm, and the resistance value Rm of the secondary transfer nipping portion S as a synthesized resistance of the secondary transfer roller 16 and the output resistance R.

$$Im1=Vm1/Rm1$$

$$Im2=Vm2/Rm2$$

From these relationship formulae, the secondary transfer current Im" and the secondary transfer current density Jm" when the resistance value at the secondary transfer nipping portion S is changed by only ΔR are as follows.

$$Vs1''=Vm1-Im1''\times R$$

$$Vs2''=Vm2-Im2''\times R$$

$$Jm1''=Im1''/L$$

$$Jm2''=Im2''/L$$

The coefficients a', b' of the linear approximation formulae when the resistance value at the secondary transfer nipping portion S changes only ΔR can be sought as follows.

$$a''=(Vs2''-Vs1'')/(Jm2''-Jm1'')$$

$$b''=(Vs1''\times Jm2''-Vs2''\times Jm1'')/(Jm2-Jm1'')$$

At Step S305, the high voltage controller 40 reads out the information on the medium width in the setting information of the roll paper P contained in the received printing data.

The high voltage controller 40 at Step S306 uses the secondary transfer reference current density Jb and the secondary transfer reference voltage Vb read out of the memory 55 at the time of the printing operation start for calculation of the secondary transfer voltage Vtr". The high voltage controller 40 calculates the secondary transfer voltage Vtr" from the electrical characteristics of the secondary transfer roller 16 calculated at Step S304, the secondary transfer reference current density Jb and the secondary transfer reference voltage Vb read out at Step S109 in FIG. 4, and the information on the medium width of the roll paper P read out at Step S108 (Step S307). The calculation method is described as follows.

The secondary transfer voltage Vc" applying to outside of the medium namely the roll paper P in the medium region where the current density of the roll paper P is the secondary transfer reference current density Jb1 is calculated using the electrical characteristics (a", b") of the secondary transfer roller 16 sought at Step S204.

$$Vc''=a''\times Jb1+b''$$

The secondary transfer between shafts voltage Vp" applying between the metal shaft 161 of the secondary transfer roller and the secondary transfer opposition roller shaft 151 in a state where the roll paper P exists at the secondary transfer nipping portion S is as follows.

$$Vp''=Vb1+Vc''$$

At that time, the secondary transfer current density Jnp" as the density of the current flowing the outside of the medium region is sought from the electrical characteristics (a", b") of the secondary transfer roller 16 sought at Step S304.

$$Jnp''=(Vp''-b'')/a''$$

If the width of the roll paper P is set to W, the secondary transfer current Itr" necessary to flow the secondary transfer roller 16 to make the secondary transfer good is a summation of the secondary transfer current flowing through the inside and the outside of the medium region, and the formula is as follows.

$$Itr''=Jb1\times W+Jnp''\times(L-W)$$

The secondary transfer voltage Vtr' applying to the secured resistor R where the secondary transfer current flows the secondary transfer roller 16 is as follows.

$$Vr''=Itr''\times R.$$

The secondary transfer voltage Vtr" necessary to flow the secondary transfer current Itr" through the secondary transfer roller 16 is a summation of the secondary transfer between shafts voltage Vp" and the secondary transfer voltage Vr" applying to the secured resistance, and therefore the secondary transfer voltage Vtr" is sought as follows.

$$Vtr''=Vp''+Vr''$$

As described above, according to this embodiment, the image forming apparatus can measure the temperature value of the metal shaft of the secondary transfer roller with the thermistor, calculate the temperature of the secondary transfer roller from the temperature valued measured and obtained, with the two formulae different between during the printing operation and during the printing operation resuming or stop, and presume the resistance change of the secondary transfer roller from the calculated temperature change of the secondary transfer roller. The image forming apparatus also can properly apply the secondary transfer voltage corresponding to the resistance change of the secondary transfer roller even where the continuous medium such, as a rod paper as the recording medium is used, by calculating the secondary transfer voltage upon correcting the electrical characteristics of the secondary transfer roller based on the resistance change presumed from the temperature change of the secondary transfer roller.

In the embodiment described above, although the image forming apparatus is exemplified as forming images to the continuous medium, this invention is applicable to any image forming apparatus forming images to standard size media precut in prescribed sizes.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. An image forming apparatus comprising:

a transfer unit having a conduct we roller member formed with a conductive elastic body on an outer peripheral surface of a shaft of the conductive roller member for transferring, to a recording medium, development images formed on an image carrier based on a transfer voltage applied thereto;

a voltage application unit for applying the transfer voltage to the transfer unit;

a voltage control unit controlling the transfer voltage to be applied from the voltage application unit to the transfer unit;

a temperature measuring unit measuring shaft temperature of the conductive roller member; and a surrounding temperature obtaining unit for obtaining an apparatus surrounding temperature, wherein the voltage control unit controls the transfer voltage applied to the transfer unit based on the shaft temperature measured with the temperature measuring unit and based on the apparatus surrounding temperature obtained from the surrounding temperature obtaining unit.

2. An image forming apparatus comprising:

a transfer unit having a conductive roller member formed with a conductive elastic body on an outer peripheral surface of a shaft of the conductive roller member for transferring, to a recording medium, development images formed on an image carrier based on a transfer voltage applied thereto;

a voltage application unit for applying the transfer voltage to the transfer unit;

a voltage control unit controlling the transfer voltage to be applied from the voltage application unit to the transfer unit; and a temperature measuring unit measuring shaft temperature of the conductive roller member, wherein the voltage control unit controls the transfer voltage applied to the transfer unit based on the shaft temperature measured with the temperature measuring unit, and wherein the voltage control unit changes formulae used for presumption, of a temperature value of the transfer unit between a period during printing operation and a period stopping printing operation in use of the shaft temperature with the temperature measuring unit.

3. The image forming apparatus according to claim 1, wherein, upon presuming the temperature of the transfer unit based on the shaft temperature measured at the temperature measuring unit and based on the apparatus surrounding temperature obtained from the surrounding temperature obtaining unit, the voltage control unit controls the transfer voltage applied to the transfer unit based on the presumed temperature of the transfer unit.

4. The image forming apparatus according to claim 3, wherein the voltage control unit changes coefficient used for formulae for presumption of the temperature of the transfer unit according to printing speed.

5. The image forming apparatus according to claim 3, further comprising a memory unit memorizing the shaft temperature measured, with the temperature measuring unit at a time of the end of the previous image forming operation; and a time measuring unit counting time lapse from the end of the previous image forming operation to resuming of the image forming operation, wherein, upon presuming the temperature of the transfer unit, based on the shaft temperature measured at the temperature measuring unit, based on the apparatus surrounding temperature obtained from the surrounding temperature obtaining unit, and based on the time lapse from, the end of the previous image forming operation to resuming of the image forming operation, the voltage control unit controls the transfer voltage applied to the transfer unit based on the presumed temperature of the transfer unit.

6. The image forming apparatus according to claim 1, wherein the transfer unit is a type of an intermediate transfer unit.

* * * * *